US007189487B2

(12) United States Patent
Ikuno et al.

(10) Patent No.: US 7,189,487 B2
(45) Date of Patent: Mar. 13, 2007

(54) ELECTROPHOTOGRAPHIC PHOTORECEPTOR, AND ELECTROPHOTOGRAPHIC APPARATUS, PROCESS CARTRIDGE AND METHOD USING THE PHOTORECEPTOR

(75) Inventors: Hiroshi Ikuno, Yokohama (JP); Takeo Tsukamoto, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/246,479

(22) Filed: Oct. 11, 2005

(65) Prior Publication Data

US 2006/0040192 A1 Feb. 23, 2006

Related U.S. Application Data

(62) Division of application No. 10/369,907, filed on Feb. 21, 2003, now Pat. No. 6,998,209.

(30) Foreign Application Priority Data

| | | |
|---|---|---|
| Feb. 21, 2002 | (JP) | 2002-045394 |
| Apr. 9, 2002 | (JP) | 2002-106845 |
| Jan. 22, 2003 | (JP) | 2003-014086 |
| Jan. 31, 2003 | (JP) | 2003-023116 |

(51) Int. Cl.
*G03G 5/047* (2006.01)

(52) U.S. Cl. ..... 430/126; 399/159

(58) Field of Classification Search ..... 430/57.2, 430/57.3, 126; 399/159
See application file for complete search history.

(56) References Cited

U.S. PATENT DOCUMENTS

| | | | |
|---|---|---|---|
| 5,002,845 | A | 3/1991 | Shimura et al. |
| 5,652,080 | A | 7/1997 | Yoshino et al. |
| 5,656,406 | A | 8/1997 | Ikuno et al. |
| 5,666,616 | A | 9/1997 | Yoshino et al. |
| 5,840,455 | A | 11/1998 | Ikuno et al. |
| 5,870,657 | A | 2/1999 | Nagame et al. |
| 5,871,876 | A | 2/1999 | Ikuno et al. |
| 5,900,342 | A | 5/1999 | Visser et al. |
| 5,923,930 | A | 7/1999 | Tsukamoto et al. |
| 5,987,282 | A | 11/1999 | Tsukamoto et al. |
| 6,007,954 | A | 12/1999 | Visser et al. |
| 6,030,733 | A | 2/2000 | Kami et al. |
| 6,072,972 | A | 6/2000 | Obu et al. |
| 6,090,511 | A | 7/2000 | Yang et al. |
| 6,131,001 | A | 10/2000 | Tsukamoto et al. |
| 6,134,394 | A | 10/2000 | Tsukamoto et al. |
| 6,148,169 | A | 11/2000 | Tsukamoto |
| 6,151,468 | A | 11/2000 | Kami et al. |
| 6,156,466 | A | 12/2000 | Tamura et al. |
| 6,226,468 | B1 | 5/2001 | Tsukamoto et al. |
| 6,366,751 | B1 | 4/2002 | Shakuto et al. |
| 6,406,823 | B2 | 6/2002 | Melnyk et al. |
| 6,432,596 | B2 | 8/2002 | Ikuno et al. |
| 6,489,073 | B2 | 12/2002 | Kotsugai et al. |
| 6,576,388 | B2 | 6/2003 | Sakon et al. |

FOREIGN PATENT DOCUMENTS

| | | |
|---|---|---|
| JP | 09-101625 | 4/1997 |
| JP | 2001-166503 | 6/2001 |
| JP | 2001-183853 | 7/2001 |
| JP | 2002-23392 | 1/2002 |

*Primary Examiner*—John L Goodrow
(74) *Attorney, Agent, or Firm*—Oblon, Spivak, McClelland, Maier & Neustadt, P.C.

(57) ABSTRACT

An electrophotographic photoreceptor including an electroconductive substrate, a charge generation layer overlying the electroconductive substrate to generate a first charge to form an electrostatic latent image when exposed to a first light, and a charge generation and transport layer overlying the charge generation layer to generate a second charge when exposed to second light and to transport the first and second charges to a surface of the photoreceptor.

6 Claims, 8 Drawing Sheets

ELECTROPHOTOGRAPHIC PHOTORECEPTOR, AND ELECTROPHOTOGRAPHIC APPARATUS, PROCESS CARTRIDGE AND METHOD USING THE PHOTORECEPTOR

BACKGROUND OF THE INVENTION

1. Field of the Invention

The present invention relates to an electrophotographic photoreceptor, and an electrophotographic apparatus, process cartridge and method using the photoreceptor.

2. Discussion of the Background

An electrophotographic method is typically one of an image forming method of charging a photoconductive photoreceptor in a dark place with, e.g., a corona discharge; irradiating the photoreceptor with imagewise light; forming an electrostatic latent image thereon by selectively scattering a charge on the irradiated part thereon; and developing the latent image with a toner including a colorant such as dyes and pigments and a binder such as polymers to form a visual toner image.

In such an electrophotographic method, the photoreceptor requires the following basic properties:

(1) the photoreceptor can be charged so as to have a proper potential in a dark place;

(2) the charge scarcely scatters in the dark place; and (3) the charge can immediately scatter when the photoreceptor is irradiated.

Conventionally, as photoreceptors for use in the electrophotographic method, a photoreceptor including a photosensitive layer mainly formed from selenium or a selenium alloy on an electroconductive substrate; a photoreceptor including an inorganic photoconductive material such as zinc oxide and cadmium sulfide in the binder; a photoreceptor using an organic photoconductive material such as poly-N-vinylcarbazole and trinitrofluorenone, or azo pigments; and a photoreceptor using an amorphous silicone material are typically known. However, recently organic electrophotographic photoreceptors are widely used because of their low production costs, high flexibility of their designs and low pollution.

As the organic electrophotographic photoreceptors, a photoconductive resin type photoreceptor typified by polyvinylcarbazole (PVK); a charge transfer complex type photoreceptor typified by PVK-TNF (2,4,7-trinitrofluorenone); a dispersed pigment type photoreceptor typified by phthalocyanine-binder; and a functionally-separated photoreceptor using a combination of a charge generation material and a charge transport material are known. Particularly, the functionally-separated photoreceptor attracts attention.

The electrostatic latent image forming mechanism in the functionally-separated photoreceptors is as follows: when light irradiates a charged photoreceptor, the light passes through the transparent charge transport layer and is absorbed by the charge generation material in the charge generation layer. The charge generation material which absorbed the light generates a charge carrier. The charge carrier is injected to the charge transport layer and transported in the charge transport layer along an electric field formed by the charge. The carrier neutralizes the charge on the surface of the photoreceptor, resulting in formation of an electrostatic latent image. In the functionally-separated photoreceptor, it is known that a combination of a charge transport material mainly absorbing ultraviolet light and a charge generation material mainly absorbing visible light is used, and such a functionally-separated photoreceptor that can satisfy the above basic properties is available.

Recently, the electrophotographic process is required to have a higher speed and a smaller size, and therefore the photoreceptor is required to have high reliability and durability to maintain high quality images even with long-term repeated use besides the above-mentioned properties.

Further, the photoreceptor receives various mechanical and chemical loads in the electrophotographic process. The chemical loads include ozone, nitrogen oxides and the like generated from a charger in the electrophotographic process. These ozone or nitrogen oxides adhere to a surface of the photoreceptor to cause a chemical reaction. The ozone oxidizes a binder resin or a charge transport material included in the photoreceptor. Therefore, a molecular chain of the binder resin is cut, and further an organic acid such as carboxylic acid is formed. In addition, the nitrogen oxides adhered to the surface of the photoreceptor are ionized by water on the surface thereof or water in the air to become a material having an electricity inductivity.

When the organic acids and the material adhere to the surface of the photoreceptor, the surface thereof has a lower resistance and an electrostatic latent image is broken. Consequently, when the latent image is developed, a flawed toner image is formed on the photoreceptor. In addition, the discharged products adhered on the photoreceptor typically increase the friction coefficient, resulting in an increase of a mechanical load by a cleaning blade onto a contact plate of the photoreceptor. Further, the above-mentioned cut of the molecular chain of the binder resin accelerates an abrasion of the photoreceptor. In addition, the ozone and nitrogen oxides are environmental problems as well.

Typically, corona chargers and contact chargers have been used as a charger in the electrophotography.

The corona chargers include a corotron method and a scorotron method including a grid, in which a corona discharge is made by applying a D.C. voltage or a D.C. voltage superimposed with an alternate current to a charge wire formed of tungsten or nickel suspended in the middle of a housing shielded with a metal plate to charge the photoreceptor. However, this method produces ozone or nitrogen oxides because a high voltage is applied to the charge wire. The products give an adverse effect not only on the environment but also the durability of the photoreceptor and the image quality produced thereby.

Recently, instead of this method, the contact charger has come into practical use for the purpose of low ozone and electric power. The contact charging method is a method in which a D.C. voltage or a D.C. voltage superimposed with an alternate current is applied to a charger having a resistance of from about $10^2$ to $10^{10}$ Ω·cm and the charger is contacted to the photoreceptor upon application of pressure to charge the photoreceptor. Because this method is performed by discharging from a charger to a body to be charged according to the Paschen's law, charging starts by applying a voltage not less than a threshold voltage. Compared with the corona charging method, the contact charging method has a lower applied voltage. However, the discharge produces a small amount of ozone and nitrogen oxides.

As a new charging method, Japanese Laid-Open Patent Publication No. 06-003921 discloses a method of directly charging a photoreceptor. In this charging method, a photoreceptor has a low resistant charge-injection layer on its surface and a voltage is applied to a contact charger such as a charging roller, a charging brush and a charging magnetic brush to charge the photoreceptor. This charging method charges only a desired part of a surface of the photoreceptor to be charged because of not using a discharge. Therefore, in comparison with the conventional charging methods, the method has much less ozone and nitrogen oxides and uses less electric power. The charge-injection layer includes a metal oxide such as a tin oxide in the resin to decrease the surface resistance of the photoreceptor. However, the surface resistance of the photoreceptor largely changes due to an environment such as temperature and humidity, in which it is used, and the photoreceptor is not stably charged. Therefore, as a method of controlling the environment of an apparatus, installing a heater in the apparatus can be considered. However, when the heater is installed, the total electric power consumption of the apparatus increases.

Japanese Laid-Open Patent Publications Nos. 8-76559 and 9-26681 disclose a method of charging a photoreceptor, in which the photoreceptor is irradiated to generate a charge, which is transported to a surface of the photoreceptor by an outside electric field. Compared with the charge-injection method, this method has less ozone and nitrogen oxides, uses less electric power, and has less change of properties of the photoreceptor due to an environment such as temperature and humidity.

In the charging methods disclosed in Japanese Laid-Open Patent Publications Nos. 8-76559 and 9-26681, existing electrophotographic photoreceptors such as a multi-layered photoreceptor including a charge transport layer overlying a charge generation layer on an electroconductive substrate and a single-layered photoreceptor including a single photosensitive layer are used.

The multi-layered photoreceptor has to transport a positive (negative) charge to a surface thereof when charged and transport a negative (positive) charge thereto when writing a latent image. Thus, the charge transport layer has to have a capability of transporting both positive and negative charges. However, at present, a material that efficiently transports both of the positive and negative charges is not available. When the single-layered photoreceptor is used, both of the positive and negative charges can be transported. However, compared with the multi-layered photoreceptor, the single-layered photoreceptor has less optical sensitivity. In addition, because the same layer generates a charge when the photoreceptor is charged and when a latent image is formed in the single-layered photoreceptor, a time between the charge generation when the photoreceptor is charged and the charge generation when the latent image is formed is limited. Therefore, the single-layered photoreceptor can neither have a smaller diameter nor produce images at a higher speed.

Japanese Laid-Open Patent Publication No. 2001-183853 discloses an electrophotographic photoreceptor including a charge generation layer when a latent image is formed, a charge transport layer, a charge generation layer when charged and an electrode at a surface end thereof on an electroconductive substrate. This photoreceptor can solve the above-mentioned problems. When the photoreceptor is charged, an electric voltage is applied to the electrode at the surface end of the photoreceptor to form an electric field and transport the charge. In this method, to uniformly charge the photoreceptor, the most surface layer thereof has to have a low resistance. When such a layer is formed, a latent image formed thereon expands and a thin line and minute dot reproducibility deteriorate.

To charge the photoreceptor and form a latent image in a good condition, charge generation materials used in respective charge generation layers are preferably different and a combination of the respective charge generation materials is considerably essential.

Because of these reasons, a need exists for an electrophotographic photoreceptor producing high quality images without producing ozone and nitrogen oxides when charged.

SUMMARY OF THE INVENTION

Accordingly, an object of the present invention is to provide an electrophotographic photoreceptor producing high quality images without producing ozone and nitrogen oxides when charged, and which is uniformly charged and has an efficient charge transport.

Another object of the present invention is to provide an image forming apparatus, a process cartridge and an image forming method using the photoreceptor.

The present invention achieves these and other objects by providing a novel electrophotographic photoreceptor including an electroconductive substrate, a charge generation layer overlying the electroconductive substrate to generate a first charge to form an electrostatic latent image when exposed to a first light, and a charge generation and transport layer overlying the charge generation layer to generate a second charge when exposed to a second light and to transport the first and second charges to a surface of the photoreceptor.

In another aspect of the present invention, an electrophotographic photoreceptor includes an electroconductive substrate, a first charge generation layer including a first charge generation material overlying the electroconductive substrate to generate a first charge to form an electrostatic latent image when exposed to a first light, a charge transport layer overlying the first charge generation layer, and a second charge generation layer including a second charge generation material overlying the charge transport layer to generate a second charge when exposed to a second light. Further, the charge transport layer transports the first charge to the second charge generation layer.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
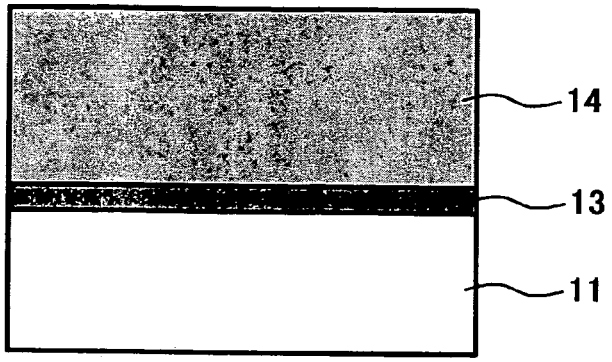
FIG. 1 is a schematic view illustrating a cross section of an embodiment of a layer structure of the photoreceptor in the present invention.

Referring now to the drawings, wherein like reference numerals designate identical or corresponding parts throughout the several views, the present invention will be described.

Generally, the present invention provides an electrophotographic photoreceptor producing high quality images without producing ozone and nitrogen oxides when charged, which is uniformly charged and has an efficient charge transport.

First, a structure of the electrophotographic photoreceptor for use in the present invention and its image forming mechanism will be explained, referring to the drawings.

FIG. 1 is a schematic view illustrating a cross section of an embodiment of a layer structure of the photoreceptor in the present invention, having a charge generation layer (hereinafter referred to as a CGL) (13) and a charge generation and transport layer (hereinafter referred to as a CGTL) (14) generating and transporting a charge on an electroconductive substrate (11).

Figure 2:
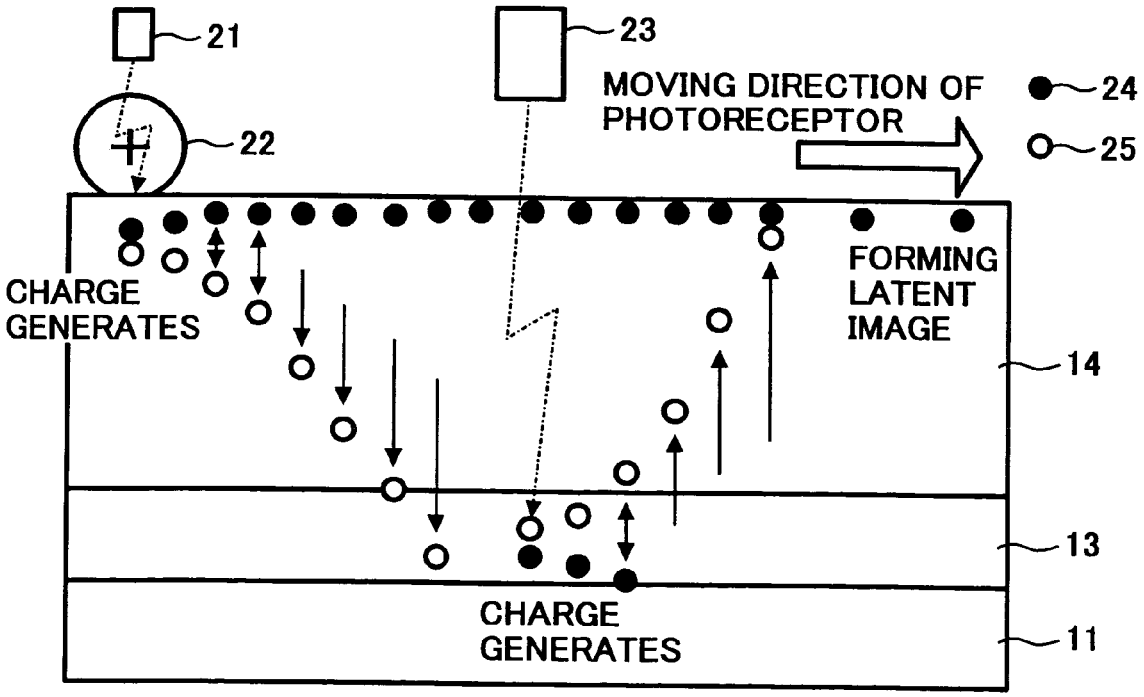
FIG. 2 is a schematic view for explaining a mechanism of charging and forming a latent image in the embodiment in FIG. 1.

FIG. 2 is a schematic view illustrating an image forming mechanism using the photoreceptor shown in FIG. 1.

Figure 3:
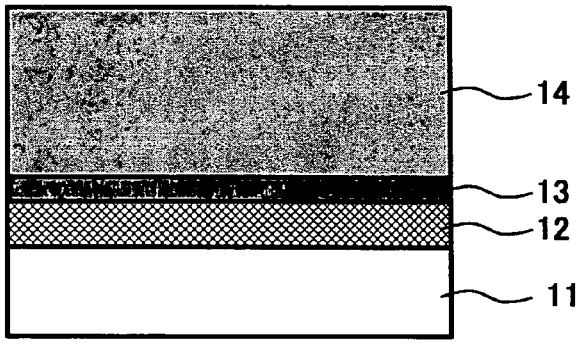
FIG. 3 is a schematic view illustrating a cross section of another embodiment of a layer structure of the photoreceptor in the present invention.

FIG. 3 is a schematic view illustrating a cross section of another embodiment of a layer structure of the photoreceptor in the present invention, having an undercoat layer (12), a CGL (13) and a CGTL (14) layered in this order on an electroconductive substrate (11).

Figure 4:
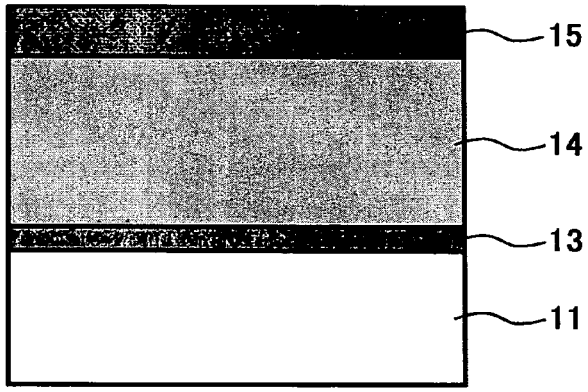
FIG. 4 is a schematic view illustrating a cross section of yet another embodiment of a layer structure of the photoreceptor in the present invention.

FIG. 4 is a schematic view illustrating a cross section of another embodiment of a layer structure of the photoreceptor in the present invention, having a CGL (13), a CGTL (14) and a protection layer (15) layered in this order on an electroconductive substrate (11).

The CGL is a layer generating a first charge to form an electrostatic latent image when exposed. The CGTL is a layer generating a second charge to charge the photoreceptor when exposed and transporting the first and second charge to a surface of the photoreceptor.

The image forming mechanism using the photoreceptor in FIG. 1 will be explained referring to FIG. 2. The photoreceptor of the present invention can positively or negatively be charged. The following explanation is an example of a negatively charged photoreceptor.

As FIG. 2 shows, first, a charging irradiator (21) uniformly irradiates the photoreceptor with light having a wavelength of $\lambda 2$. The CGTL (14) including a charge generation material having a high absorbance of the light having a wavelength of $\lambda 2$ generates a charge.

When the irradiation is performed, a bias applicator (22) applies a positive bias to a member contacted or located closely thereto. Therefore, an electric field is formed in the photoreceptor, and a hole (25) and an electron (24) are separated by the electric field. The electron (24) is transported toward the surface of the photoreceptor and the hole is transported toward the electroconductive substrate (11). Thus, a uniform negatively charged sheet is formed on the surface of the photoreceptor.

Next, according to an image signal, an irradiator (23) irradiates the photoreceptor with light having a wavelength $\lambda 1$. The CGL including a charge generation material having a high absorbance of the light having a wavelength of $\lambda 1$ generates a charge according to a writing signal. A hole (25) of the charge is transported toward the surface of the photoreceptor and an electron (24) thereof is transported toward the electroconductive substrate (11). Then, the hole (25) and the electron (24) are combined again on the surface of the photoreceptor to form an electrostatic latent image.

The $\lambda 1$ and $\lambda 2$ preferably have a different wavelength. In addition, the bias applied to the member contacted or located closely to the bias applicator (22) is a bias not greater than a voltage with which a discharge starts according to the Paschen's law.

In addition, as is understandable in FIGS. 1, 3 and 4, the photoreceptor of the present invention includes at least the CGL and CGTL and may optionally include other layers.

Figure 5:
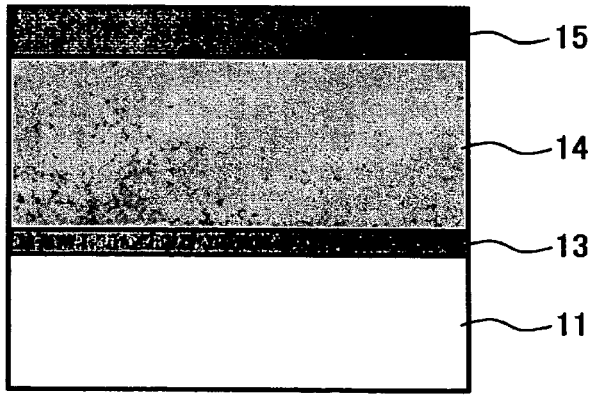
FIG. 5 is a schematic view illustrating a cross section of still another embodiment of a layer structure of the photoreceptor in the present invention.

FIG. 5 is a schematic view illustrating a cross section of another embodiment of a layer structure of the photoreceptor in the present invention, having a CGL 1 (13), a charge transport layer (hereinafter referred to as a CTL) (14) and a CGL 2 (15) in this order on an electroconductive substrate (11).

The CGL 1 is a layer generating a first charge to form an electrostatic latent image when exposed to light. The CGL 2 is a layer generating a second charge to charge the photoreceptor when exposed. The CTL is a layer transporting the first and second charge toward the electroconductive substrate or surface of the photoreceptor. A charge generation material for use in the CGL 1 is a phthalocyanine pigment and a charge generation material for use in the CGL 2 is an azo pigment.

The azo pigment having the following formula (1) can effectively be used:

(1)

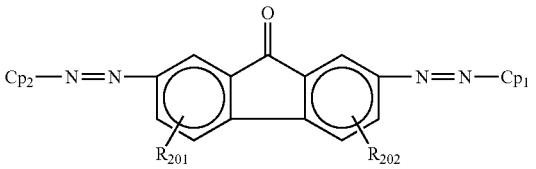

where $Cp_1$ and $Cp_2$ independently represent a coupler residue, and $R_{201}$ and $R_{202}$ independently represent a hydrogen atom, a halogen atom, an alkyl group, an alkoxy group and a cyano group.

In addition, $Cp_1$ and $Cp_2$ have the following formula (2):

(2)

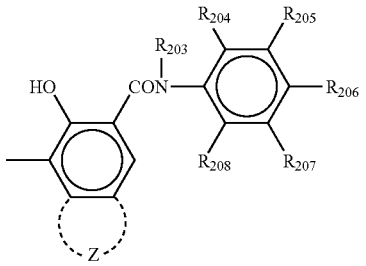

where $R_{203}$ represents an alkyl group such as a hydrogen atom, a methyl group and an ethyl group, and an aryl group such as a phenyl group. $R_{204}$, $R_{205}$, $R_{206}$, $R_{207}$ and $R_{208}$ independently represent a halogen atom such as a hydrogen atom, a nitro group, a cyano group, a fluorine atom, a chlorine atom and an iodine atom; an alkyl group such as a trifluoromethyl group, a methyl group and an ethyl group; an alkoxy group such as a methoxy group and an ethoxy group; dialkylamino group; and a hydroxyl group. Z represents atoms which are required to form a substituted or an unsubstituted aromatic carbon ring, or a substituted or an unsubstituted aromatic heterocycle.

As the phthalocyanine pigment, titanylphthalocyanine can preferably be used. Particularly, the titanylphthalocyanine having the maximum diffraction peak at 27.2° as a diffraction peak (±0.2°) of a Bragg angle 2θ against a characteristic radiation having a wavelength of 1.514 Å of CuKα, is effectively used.

Figure 6:
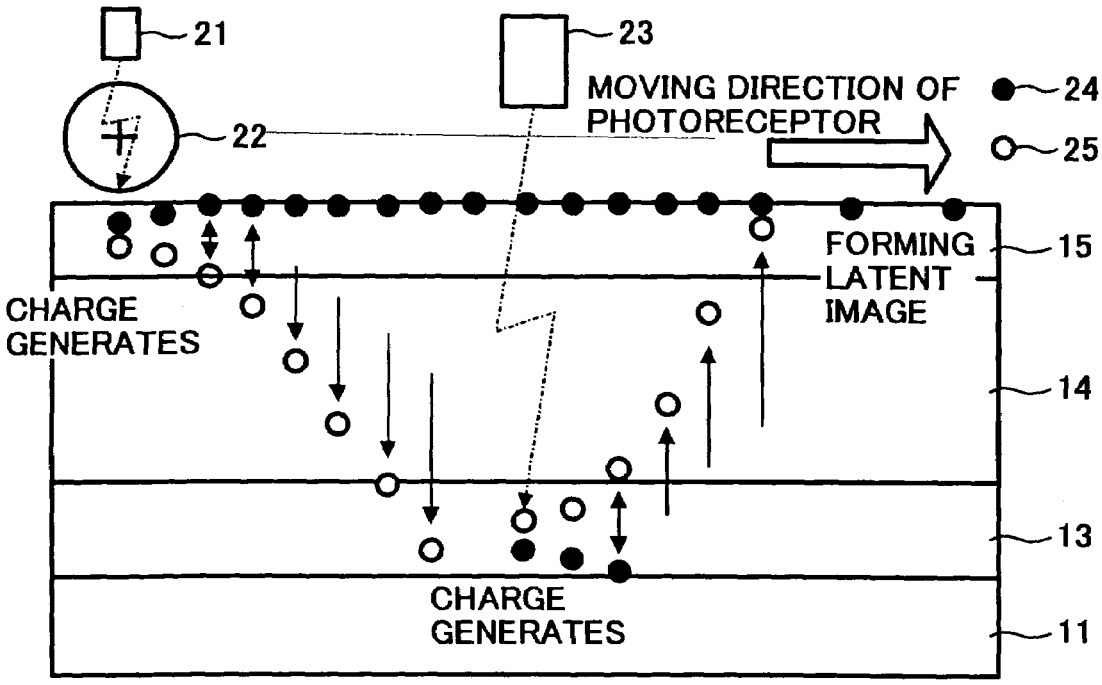
FIG. 6 is a schematic view for explaining a mechanism of charging and forming a latent image in the embodiment in FIG. 5.

FIG. 6 is a schematic view illustrating an image forming mechanism using the photoreceptor shown in FIG. 5. The photoreceptor of the present invention can positively or negatively be charged by selecting a charge transport material. The following explanation is an example of a negatively charged photoreceptor.

As FIG. 6 shows, first, a charging irradiator (21) uniformly irradiates the photoreceptor with light having a wavelength of λ2. The CGL 1 including a charge generation material having a high absorbance of the light having a wavelength of λ2 (an azo pigment) generates a charge. At the same time, a bias applicator (22) applies a positive bias to a member contacted or located closely thereto. Therefore, an electric field is formed in the photoreceptor, and a hole (25) and an electron (24) are separated by the electric field. The electron (24) is transported toward the surface of the photoreceptor and the hole (25) is transported toward the electroconductive substrate (11). Thus, a uniform negatively charged sheet is formed on the surface of the photoreceptor.

Next, according to an image signal, an irradiator (23) irradiates the photoreceptor with light having a wavelength λ1. The CGL 2 including a charge generation material having a high absorbance of the light having a wavelength of λ1 (a phthalocyanine pigment) generates a charge according to a writing signal. A hole (25) of the charge is transported toward the surface of the photoreceptor and an electron (24) thereof is transported toward the electroconductive substrate (11). Then, the hole (25) and the electron (24) are combined again on the surface of the photoreceptor to form an electrostatic latent image.

The λ1 and λ2 have a different wavelength, and the λ1 has a wavelength not less than 700 nm and the λ2 has a wavelength not greater than 660 nm. In addition, the bias applied to the member contacted or located closely to the bias applicator (22) is a bias not greater than a voltage with which a discharge starts according the Paschen's law.

Figure 7:
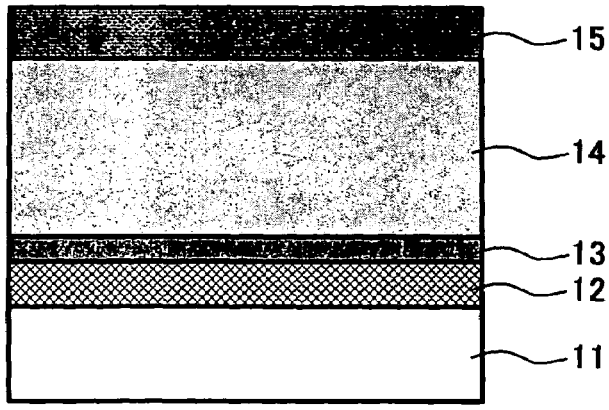
FIG. 7 is a schematic view illustrating a cross section of another embodiment of a layer structure of the photoreceptor in the present invention.

FIG. 7 is a schematic view illustrating a cross section of another embodiment of a layer structure of the photoreceptor in the present invention, having an undercoat layer (12), a CGL 1 (13), a CTL (14) and a CGL 2 (15) layered in this order on an electroconductive substrate (11).

Figure 8:
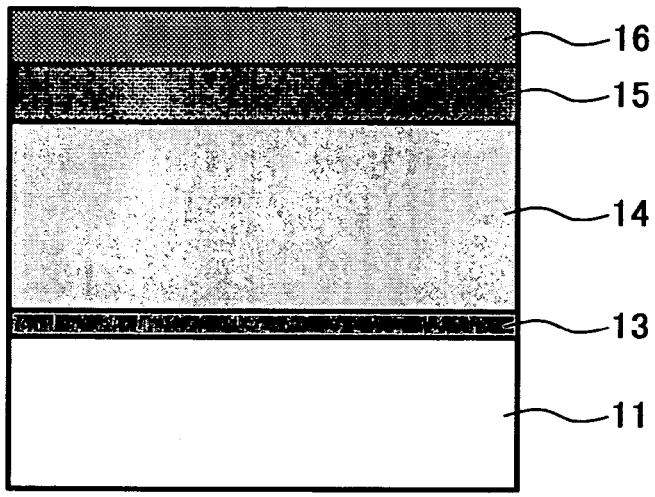
FIG. 8 is a schematic view illustrating a cross section of another embodiment of a layer structure of the photoreceptor in the present invention.

FIG. 8 is a schematic view illustrating a cross section of another embodiment of a layer structure of the photoreceptor in the present invention, having a CGL 1 (13), a CTL (14), CGL 2 (15) and a protection layer (16) layered in this order on an electroconductive substrate (11).

The photoreceptor of the present invention includes at least the CGL 1, CTL and CGL 2 and may optionally include other layers.

Suitable materials for use as the electroconductive substrate include materials having a volume resistance not greater than $10^{10}$ Ω·cm. Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indium oxides and the like, is deposited or sputtered. In addition, a plate of a metal such as aluminum, aluminum alloys, nickel and stainless steel and a metal cylinder, which is prepared by tubing a metal such as the metals mentioned above by a method such as impact ironing or direct ironing, and then treating the surface of the tube by cutting, super finishing, polishing and the like treatments, can also be used as the substrate. Further, endless belts of a metal such as nickel and stainless steel, which have been disclosed in Japanese Laid-Open Patent Publication No. 52-36016, can also be used as the substrate.

Furthermore, substrates, in which a coating liquid including a binder resin and an electroconductive powder is coated on the supporters mentioned above, can be used as the substrate. Specific examples of such an electroconductive powder include carbon black, acetylene black, powders of metals such as aluminum, nickel, iron, Nichrome, copper, zinc, silver and the like, and metal oxides such as electroconductive tin oxides, ITO and the like.

Specific examples of the binder resin include known thermoplastic resins, thermosetting resins and photocrosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like resins. Such an electroconductive layer can be formed by coating a coating liquid in which an electroconductive powder and a binder resin are dispersed in a solvent such as tetrahydrofuran, dichloromethane, methyl ethyl ketone, toluene and the like solvent, and then drying the coated liquid.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins, with an electroconductive material, can also be used as the substrate.

Next, the CGL will be explained.

The CGL includes a charge generation material as a main component. In the CGL, known charge generation materials can be used. Specific examples of such charge generation materials include monoazo pigments, disazo pigments, trisazo pigments, perylene pigments, perynone pigments, quinacridone pigments, quinone type condensed polycyclic compounds, squaric acid type dyes, other phthalocyanine pigments, naphthalocyanine pigments, azulenium salt type dyes, and the like pigments and dyes. These charge generation materials can be used alone or in combination. Among these charge generation materials, azo pigments and/or phthalocyanine pigments are preferably used. Particularly, the phthalocyanine pigments are effectively used in the CGL 1.

The CGL and CGL 1 can be prepared by dispersing a charge generation material in a proper solvent together with a binder resin using a ball mill, an attritor, a sand mill or a supersonic dispersing machine, coating the coating liquid on an electroconductive substrate and then drying the coated liquid.

Suitable binder resins optionally for use in the CGL include polyamides, polyurethanes, epoxy resins, polyketones, polycarbonates, silicone resins, acrylic resins, polyvinyl butyral, polyvinyl formal, polyvinyl ketones, polystyrene, polysulfone, poly-N-vinylcarbazole, polyacrylamide, polyvinyl benzal, polyesters, phenoxy resins, vinyl chloride-vinyl acetate copolymers, polyvinyl acetate, polyphenylene oxide, polyamides, polyvinyl pyridine, cellulose resins, casein, polyvinyl alcohol, polyvinyl pyrrolidone, and the like resins. The content of the binder resin in the CGL is preferably from 0 to 500 parts by weight, and preferably from 10 to 300 parts by weight, per 100 parts by weight of the charge generation material.

Suitable solvents for use in the coating liquid include isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, ligroin, and the like solvents. In particular, ketone type solvents, ester type solvents and ether type solvents are preferably used. The coating liquid can be coated by a coating method such as dip coating, spray coating, bead coating, nozzle coating, spinner coating and ring coating. The thickness of the CGL is preferably from 0.01 to 5 μm, and more preferably from 0.1 to 2 μm.

The CGTL can be formed by dissolving or dispersing a charge generation material, a charge transport material and a binder resin in a proper solvent coating the coating liquid on the charge generation layer and drying the coated liquid. Additives such as plasticizers, leveling agents, antioxidants and the like may be included if desired.

The charge generation material includes the materials used in the CGL, and azo pigments and/or phthalocyanine pigments are preferably used.

Particularly, when a CGL includes the phthalocyanine pigments and a CGTL includes the azo pigments, the resultant photoreceptor can preferably be charged and form an electrostatic latent image.

The CTL can also be formed by dissolving or dispersing a charge transport material and a binder resin in a proper solvent to prepare a coating liquid, coating the coating liquid on the charge generation layer and drying the coated liquid. Additives such as plasticizers, leveling agents, antioxidants and the like may be included if desired.

Charge transport materials are classified into positive-hole transport materials and electron transport materials. Specific examples of the electron transport materials include electron accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetanitroxanthone, 2,4,8-trinitrothioxanthone, 2,6,8-trinitro-4H-indeno[1,2-b]thiophene-4-one, 1,3,7-trinitrodibenzothiphene-5,5-dioxide, benzoquinone derivatives and the like.

Specific examples of the positive-hole transport materials include known materials such as poly-N-carbazole and its derivatives, poly-γ-carbazolylethylglutamate and its derivatives, pyrene-formaldehyde condensation products and their derivatives, polyvinyl pyrene, polyvinyl phenanthrene, polysilane, oxazole derivatives, oxadiazole derivatives, imidazole derivatives, monoarylamines, diarylamines, triarylamines, stilbene derivatives, α-phenyl stilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, and the like. These charge transport materials can be used alone or in combination.

Specific examples of the binder resin include thermoplastic resins, thermosetting resins such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like.

In addition, a charge transport polymer material can be used as a charge transport material. The charge transport polymer materials have the following constitutions.

(a) Polymers having a carbazole ring include poly-N-vinyl carbazole, and compounds disclosed in Japanese Laid-Open Patent Publications Nos. 50-82056, 54-9632, 54-11737, 4-175337, 4-183719 and 6-234841. (b) Polymers having a hydrazone skeleton include compounds disclosed in Japanese Laid-Open Patent Publications Nos. 57-78402, 61-20953, 61-296358, 1-134456, 1-179164, 3-180851, 3-180852, 3-50555, 5-310904 and 6-234840. (c) Polysilylene compounds include compounds disclosed in Japanese Laid-Open Patent Publications Nos. 63-285552, 1-88461, 4-264130, 4-264131, 4-264132, 4-264133 and 4-289867. (d) Polymers having a triaryl amine skeleton include N,N-bis(4-methylphenyl)-4-aminopolystyrene, and compounds disclosed in Japanese Laid-Open Patent Publications Nos. 1-134457, 2-282264, 2-304452, 4-133065, 4-133066, 5-40350 and 5-202135. (e) Other polymers include condensation products of nitropyrene with formaldehyde, and compounds disclosed in Japanese Laid-Open Patent Publications Nos. 51-73888, 56-150749, 6-234836 and 6-234837.

The polymer having an electron donating group for use in the present invention is not limited to the polymers mentioned above, and any known copolymers, block copolymers and graft copolymers and star polymers of known monomers can also be used. In addition, crosslinking polymers having an electron donating group disclosed in, for example, Japanese Laid-Open Patent Publication No. 3-109406 can also be used.

As the polycarbonates, polyurethanes, polyesters and polyethers which are useful as a charge transport polymer material for use in the present invention, and which have a triaryl amine structure, the following compounds are exemplified.

Compounds disclosed, for example, in Japanese Laid-Open Patent Publications Nos. 64-1728, 64-13061, 64-19049, 4-11627, 4-225014, 4-230767, 4-320420, 5-232727, 7-56374, 9-127713, 9-222740, 9-265197, 9-211877 and 9-304956.

The content of the charge transport material is preferably from 20 to 300 parts by weight, and more preferably from 40 to 150 parts by weight, per 100 parts by weight of the binder resin. The thickness of the CTL is preferably not greater than 25 μm in view of resolution of the resultant images and response. The lower limit of the thickness is preferably not less than 5 μm, although it depends on the image forming system (particularly on the electric potential).

The thickness of the CGTL is preferably from 5 to 100 μm, and more preferably not greater than 25 μm in view of the resolution of the resultant images and response. The lower limit of the thickness is preferably not less than 5 μm, although it depends on the image forming system (particularly on the electric potential).

Suitable solvents for use in the coating liquid include tetrahydrofuran, dioxane, toluene, dichloromethane, monochlorobenzene, dichloroethane, cyclohexanone, methyl ethyl ketone, acetone and the like solvents.

The CTL of the photoreceptor in the present invention may include additives such as plasticizers and leveling agents. Specific examples of the plasticizers include known plasticizers, which are used for plasticizing resins, such as dibutyl phthalate, dioctyl phthalate and the like. The addition quantity of the plasticizer is 0 to 30% by weight of the binder resin. Specific examples of the leveling agents include silicone oils such as dimethyl silicone oil, and methyl phenyl silicone oil; polymers or oligomers including a perfluoroalkyl group in their side chain; and the like. The addition quantity of the leveling agents is 0 to 1% by weight of the binder resin.

Because the CGTL is occasionally an outermost surface layer of a photoreceptor, it may include a filler for the purpose of improving the durability. Specific examples of the organic fillers include powders of fluorine-containing resins such as polytetrafluoroethylene, silicone resin powders and amorphous carbon powders. Specific examples of the inorganic fillers include powders of metals such as copper, tin, aluminum and indium; metal oxides such as silica, tin oxide, zinc oxide, titanium oxide, indium oxide, antimony oxide, bismuth oxide, tin oxide doped with antimony, indium oxide doped with tin, and potassium titanate. Among these fillers, inorganic fillers are preferably used in view of hardness. In particular, silica, titanium oxide and alumina are preferably used.

The CGL 2 includes a charge generation material as a main component. Particularly, an azo pigment is preferably used in the CGL 2, and a bisazo pigment having a high absorbance is more preferably used therein. The CGL 2 is formed by the same coating method as that of the CGL 1.

Because the CGL 2 is occasionally an outermost surface layer of a photoreceptor, it may include a filler for the purpose of improving the durability. Specific examples of the organic fillers include powders of fluorine-containing resins such as polytetrafluoroethylene, silicone resin powders and amorphous carbon powders. Specific examples of the inorganic fillers include powders of metals such as copper, tin, aluminum and indium; metal oxides such as silica, tin oxide, zinc oxide, titanium oxide, indium oxide, antimony oxide, bismuth oxide, tin oxide doped with antimony, indium oxide doped with tin, and potassium titanate. Among these fillers, inorganic fillers are preferably used in view of hardness. In particular, silica, titanium oxide and alumina are preferably used.

The CGL 2 preferably has a thickness of from 0.1 to 10 μm, and more preferably from 1 to 5 μm.

A combination of using a phthalocyanine pigment with a high absorbance for light having a wavelength of 780 nm in the CGL 1 and a bisazo pigment with a high absorbance for light having a wavelength of 655 nm in the CGL 2 is preferably used.

The charge generation materials used in the CGL and CGTL are not limited to specific materials. The charge generation materials used in the CGL and those used in the CGTL are preferably different from each other, and further it is more preferable that each of the materials has a different maximum absorption wavelength.

In the present invention, the charge generation materials used in the CGTL preferably do not absorb light to form an electrostatic latent image, and at least have a lower absorbance than the charge generation materials used in the CGL.

Figure 12:
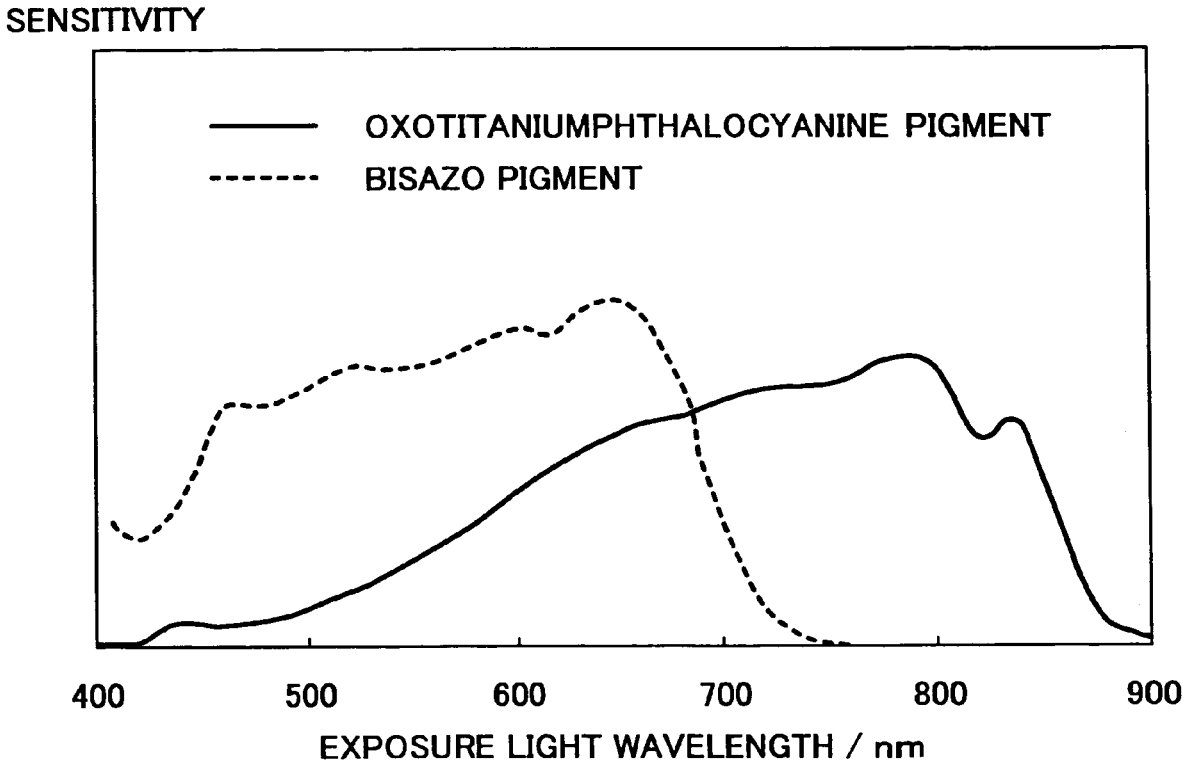
FIG. 12 is a spectral responsivity of pigments for use in the charge generation layer of the present invention.

Specifically, as FIG. 12 shows, a phthalocyanine pigment with a high absorbance for light having a wavelength of 780 nm and a bisazo pigment with a high absorbance for light having a wavelength of 655 nm are preferably used.

In the photoreceptor of the present invention, an undercoat layer may be formed between the substrate and the CGL 1. The undercoat layer includes a resin as a main component. Because a photosensitive layer is typically formed on the undercoat layer by coating a liquid including an organic solvent, the resin in the undercoat layer preferably has a good resistance to general organic solvents. Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins, epoxy resins and the like. The undercoat layer may include a fine powder of metal oxides such as titanium oxide, silica, alumina, zirconium oxide, tin oxide and indium oxide to prevent occurrence of moiré in the recorded images and to decrease residual potential of the photoreceptor.

The undercoat layer can also be formed by coating a coating liquid using a proper solvent and a proper coating method similarly to those for use in formation of the photosensitive layer mentioned above. The undercoat layer may be formed using a silane coupling agent, titanium coupling agent or a chromium coupling agent. In addition, a layer of aluminum oxide which is formed by an anodic oxidation method and a layer of an organic compound such as polyparaxylylene (parylene) or an inorganic compound such as SiO, $SnO_2$, $TiO_2$, ITO or $CeO_2$ which is formed by a vacuum evaporation method is also preferably used as the undercoat layer. The thickness of the undercoat layer is preferably 0 to 5 μm.

In the photoreceptor of the present invention, for the purpose of improving mechanical durability thereof, a surface protection layer is formed on the CGTL or CGL 2.

The surface protection layer preferably has a diamond-like carbon or an amorphous carbon structure including a hydrogen atom, or a structure in which a filler is dispersed in the binder.

The surface protection layer having a diamond-like carbon or an amorphous carbon structure including a hydrogen atom preferably has a C-C combination which is similar to a diamond having a $SP^3$ orbit. In addition, the surface protection layer may have a structure which is similar to a graphite having a $SP^2$ orbit or an amorphous structure. The surface protection layer preferably includes a nitrogen atom, a fluorine atom, a boron atom, a phosphorous atom, a chlorine atom, a bromine atom and an iodine atom as additive elements. The surface protection layer preferably has a thickness of from 0.5 to 5 μm.

When the surface protection layer is formed, a hydrocarbon gas such as methane, ethane, ethylene and acetylene as a main component, and a carrier gas such as $H_s$ and Ar is used. Further, a gas supplying the above-mentioned additive elements may be a gas which can be vaporized when depressurized or heated. Specific examples of the gas supplying a nitrogen atom include $NH_3$, $N_2$ and the like gas. Specific examples of the gas supplying a fluorine atom include $C_2F_6$, $CH_3F$ and the like gas. Specific examples of the gas supplying a boron atom include $B_2H_6$ and the like gas. Specific examples of the gas supplying a phosphorous atom include $PH_3$ and the like gas. Specific examples of the gas supplying a chlorine atom include $CH_3Cl$, $CH_2CL_2$, $CHCL_3$, $CCL_4$ and the like gas. Specific examples of the gas supplying a bromine atom include $CH_3Br$ and the like gas. Specific examples of the gas supplying an iodine atom include $CH_3I$ and the like gas.

In addition, specific examples of the gas supplying plural additive elements include $NF_3$, $BCL_3$, BBr, $BF_3$, $PF_3$, $PCL_3$ and the like gas. The surface protection layer is formed by a plasma CVD method, a glow discharge decomposition method, an optical CVD method, a sputtering method targeting a graphite and the like methods using the above-mentioned gas. The method is not particularly limited. However, as a method of forming a preferable protection layer including a carbon atom as a main component, Japanese Laid-Open Patent Publication No. 58-49609 discloses a method of forming the protection layer, which is a Plasma CVD method accompanied with a sputtering effect.

Because the method of forming a protection layer including a carbon atom as a main component using the plasma CVD method does not have to particularly heat a substrate, it is advantageous to form a protection layer on an organic photosensitive layer having a low heat resistance.

Next, the surface protection layer including a binder resin in which a filler is dispersed will be explained.

Specific examples of the binder resin for use in the surface protection layer include ABS resins, ACS resins, olefin-vinyl monomer copolymers, chlorinated polyethers, aryl resins, phenolic resins, polyacetal, polyamides, polyamide-imide, polyacrylates, polyarylsulfone, polybutylene, polybutylene terephthalate, polycarbonate, polyethersulfone, polyethylene, polyethylene terephthalate, polyimides, acrylic resins, polymethylpentene, polypropylene, polyphenyleneoxide, polysulfone, polystyrene, polyarylate, AS resins, butadiene-styrene copolymers, polyurethane, polyvinyl chloride, polyvinylidene chloride, epoxy resins and the like. Among these resins, the polycarbonate resins and the polyarylate resins are preferably used. These binder resins can be used alone or in combination.

The surface protection layer of the photoreceptor may include a filler for the purpose of improving the durability. Specific examples of the organic fillers include powders of fluorine-containing resins such as polytetrafluoroethylene, silicone resin powders and amorphous carbon powders. Specific examples of the inorganic fillers include powders of metals such as copper, tin, aluminum and indium; metal oxides such as silica, tin oxide, zinc oxide, titanium oxide, indium oxide, antimony oxide, bismuth oxide, tin oxide doped with antimony, indium oxide doped with tin, and potassium titanate. Among these fillers, inorganic fillers are preferably used in view of hardness. In particular, silica, titanium oxide and alumina are preferably used.

The average primary particle diameter of the filler included in the protection layer is preferably from 0.01 to 0.5 μm to improve the light-transmittance and abrasion resistance of the protection layer. When the average primary particle diameter of the filler is too small, the abrasion resistance of the protection layer and the dispersibility of the filler in a coating liquid deteriorate. To the contrary, when the average primary particle diameter of the filler is too large, precipitation of the filler in a coating liquid and toner filming tend to occur.

The more the concentration of the filler included in the protection layer, the better the abrasion resistance of the protection layer. However, when the concentration is too high, residual potential of the resultant photoreceptor increases and the transmittance of the protection layer deteriorates. Therefore, the content of the filler is preferably not greater than 50% by weight, and more preferably not greater than 30% by weight, based on a total weight of the protection layer. The minimum content thereof is typically 5% by weight.

These fillers are preferably treated with at least one surface treating agent to improve the dispersibility thereof. Deterioration of dispersibility of a filler included in the protection layer causes not only an increase of residual potential but also a decrease of transparency of the protection layer, generation of coating deficiencies, and deterioration of an abrasion resistance, and thereby a photoreceptor having a good durability and capable of producing good images cannot be provided. Suitable surface treating agents include known surface treating agents, but surface treating agents which can maintain the insulating properties of the filler in the protection layer are preferably used. Specific examples of such surface treating agents include titanate coupling agents, aluminum coupling agents, zircoaluminate coupling agents, higher fatty acids, and combinations of these agents with silane coupling agents; and $Al_2O_3$, $TiO_2$, $ZrO_2$, silicones, aluminum stearate, and their mixtures. These are preferably used because of being capable of imparting good dispersibility to fillers and preventing blurred images. When silane coupling agents are used, the blurred images tends to be produced. However, when used in combination with the surface treating agents mentioned above, the blurred images can often be avoided. The content of the surface treating agent in the filler, which depends on the primary particle diameter of the filler, is from 3 to 30% by weight, and more preferably from 5 to 20% by weight. When the content is too low, good dispersibility cannot be obtained. To the contrary, when the content is too high, residual potential seriously increases. These fillers can be used alone or in combination.

The surface protection layer preferably has an average maximum thickness of from 1.0 to 8.0 μm. In consideration of a long-term repeated use, the surface protection layer preferably has a thickness not less than 1.0 μm. When the thickness is greater than 8.0 μm, residual potential of the resultant photoreceptor increases and a minute dot reproducibility thereof deteriorates.

These fillers can be dispersed by using a proper disperser. The average particle diameter of the filler dispersed in the protection layer dispersion liquid is preferably not greater than 1 μm, and more preferably not greater than 0.5 μm.

The fillers are dispersed in the surface protection layer.

In the photoreceptor of the present invention, one or more additives such as antioxidants, plasticizers, lubricants, ultraviolet absorbents, low molecular weight charge transport materials and leveling agents can be used in each of the layers to improve the stability to withstand environmental conditions, namely to avoid a decrease of photosensitivity and increase of residual potential. Such compounds will be shown as follows.

Suitable antioxidants for use in each of the layers of the photoreceptor include the following compounds but are not limited thereto.

(a) Phenolic compounds include 2,6-di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, tocophenol compounds, and the like. (b) Paraphenylenediamine compounds include N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, and the like. (c) Hydroquinone compounds include 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone and the like. (d) Organic sulfinur-containing compounds include dilauryl-3,3'-thiodipropionate, distearyl-3,3'-thiodipropionate, ditetradecyl-3,3'-thiodipropionate, and the like. (e) Organic phosphorus-containing compounds include triphenylphosphine, tri(nonylphenyl)phosphine, tri(dinonylphenyl)phosphine, tricresylphosphine, tri(2,4-dibutylphenoxy)phosphine and the like.

Suitable plasticizers for use in each of the layers of the photoreceptor include the following compounds but are not limited thereto.

(a) Phosphoric acid esters plasticizers include triphenyl phosphate, tricresyl phosphate, trioctyl phosphate, octyldiphenyl phosphate, trichloroethyl phosphate, cresyldiphenyl phosphate, tributyl phosphate, tri-2-ethylhexyl phosphate, triphenyl phosphate, and the like. (b) Phthalic acid esters plasticizers include dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butylbenzyl phthalate, butyllauryl phthalate, methyloleyl phthalate, octyldecyl phthalate, dibutyl fumarate, dioctyl fumarate, and the like. (c) Aromatic carboxylic acid esters plasticizers include trioctyl trimellitate, tri-n-octyl trimellitate, octyl oxybenzoate, and the like. (d) Dibasic fatty acid esters plasticizers include dibutyl adipate, di-n-hexyl adipate, di-2-ethylhexyl adipate, di-n-octyl adipate, n-octyl-n-decyl adipate, diisodecyl adipate, dialkyl adipate, dicapryl adipate, di-2-etylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate, di-n-octyl tetrahydrophthalate, and the like. (e) Fatty acid ester derivatives include butyl oleate, glycerin monooleate, methyl acetylricinolate, pentaerythritol esters, dipentaerythritol hexaesters, triacetin, tributyrin, and the like. (f) Oxyacid esters plasticizers include methyl acetylricinolate, butyl acetylricinolate, butylphthalylbutyl glycolate, tributyl acetylcitrate, and the like. (g) Epoxy plasticizers include epoxydized soybean oil, epoxydized linseed oil, butyl epoxystearate, decyl epoxystearate, octyl epoxystearate, benzyl epoxystearate, dioctyl epoxyhexahydrophthalate, didecyl epoxyhexahydrophthalate, and the like. (h) Dihydric alcohol esters plasticizers include diethylene glycol dibenzoate, triethylene glycol di-2-ethylbutyrate, and the like. (i) Chlorine-containing plasticizers include chlorinated paraffin, chlorinated diphenyl, methyl esters of chlorinated fatty acids, methyl esters of methoxychlorinated fatty acids, and the like. (j) Polyester plasticizers include polypropylene adipate, polypropylene sebacate, acetylated polyesters, and the like. (k) Sulfonic acid derivatives include p-toluene sulfonamide, o-toluene sulfonamide, p-toluene sulfoneethylamide, o-toluene sulfoneethylamide, toluene sulfone-N-ethylamide, p-toluene sulfone-N-cyclohexylamide, and the like. (l) Citric acid derivatives include triethyl citrate, triethyl acetylcitrate, tributyl citrate, tributyl acetylcitrate, tri-2-ethylhexyl acetylcitrate, n-octyldecyl acetylcitrate, and the like. (m) Other compounds include terphenyl, partially hydrated terphenyl, camphor, 2-nitro diphenyl, dinonyl naphthalene, methyl abietate, and the like.

Suitable lubricants for use in each of the layers of the photoreceptor include the following compounds but are not limited thereto.

(a) Hydrocarbon compounds include liquid paraffins, paraffin waxes, micro waxes, low molecular weight polyethylenes, and the like. (b) Fatty acid compounds include lauric acid, myristic acid, palmitic acid, stearic acid, arachidic acid, behenic acid, and the like. (c) Fatty acid amide compounds include stearic acid amide, palmitic acid amide, oleic acid amide, methylenebisstearamide, ethylenebisstearamide, and the like. (d) Ester compounds include lower alcohol esters of fatty acids, polyhydric alcohol esters of fatty acids, polyglycol esters of fatty acids, and the like. (e) Alcohol compounds include cetyl alcohol, stearyl alcohol, ethylene glycol, polyethylene glycol, polyglycerol, and the like. (f) Metallic soaps include lead stearate, cadmium stearate, barium stearate, calcium stearate, zinc stearate, magnesium stearate, and the like. (g) Natural waxes include carnauba wax, candelilla wax, beeswax, spermaceti, insect wax, montan wax, and the like. (h) Other compounds include silicone compounds, fluorine compounds, and the like.

Suitable ultraviolet absorbing agents for use in each of the layers of the photoreceptor include the following compounds but are not limited thereto.

(a) Benzophenone compounds include 2-hydroxybeiizophenone, 2,4-dihydroxybenzophenone, 2,2',4-trihydroxybenzophenone, 2,2',4,4'-tetrahydroxybenzophenone, 2,2'-dihydroxy-4-methoxybenzophenone, and the like. (b) Salicylate compounds include phenyl salicylate, 2,4-di-t-butylphenyl-3,5-di-t-butyl-4-hydroxybenzoate, and the like. (c) Benzotriazole compounds include (2'-hydroxyphenyl) benzotriazole, (2'-hydroxy-5'-methylphenyl)benzotriazole and (2'-hydroxy-3'-t-butyl-5'-methylphenyl)-5-chlorobenzotriazole. (d) Cyano acrylate compounds include ethyl-2-cyano-3,3-diphenyl acrylate, methyl-2-carbomethoxy-3-(paramethoxy) acrylate, and the like. (e) Quenchers (metal complexes) include nickel(2,2'-thiobis(4-t-octyl)phenolate)-n-butylamine, nickeldibutyldithiocarbamate, cobaltdicyclohexyldithiophosphate, and the like. (f) HALS (hindered amines) include bis(2,2,6,6-tetramethyl-4-piperidyl)sebacate, bis(1,2,2,6,6-pentamethyl-4-piperidyl)sebacate, 1-[2-{3-(3,5-di-t-butyl-4-hydroxyphenyl)propionyloxy}ethyl]-4-{3-(3,5-di-t-butyl-4-hydroxyphenyl)propionyloxy}-2,2,6,6-tetrametylpyridine, 8-benzyl-7,7,9,9-tetramethyl-3-octyl-1,3,8-triazaspiro[4,5]undecane-2,4-dione, 4-benzoyloxy-2,2,6,6-tetramethylpiperidine, and the like.

The electrophotographic method and apparatus using the photoreceptor of the present invention will be explained further in detail, referring to the drawings.

Figure 9:
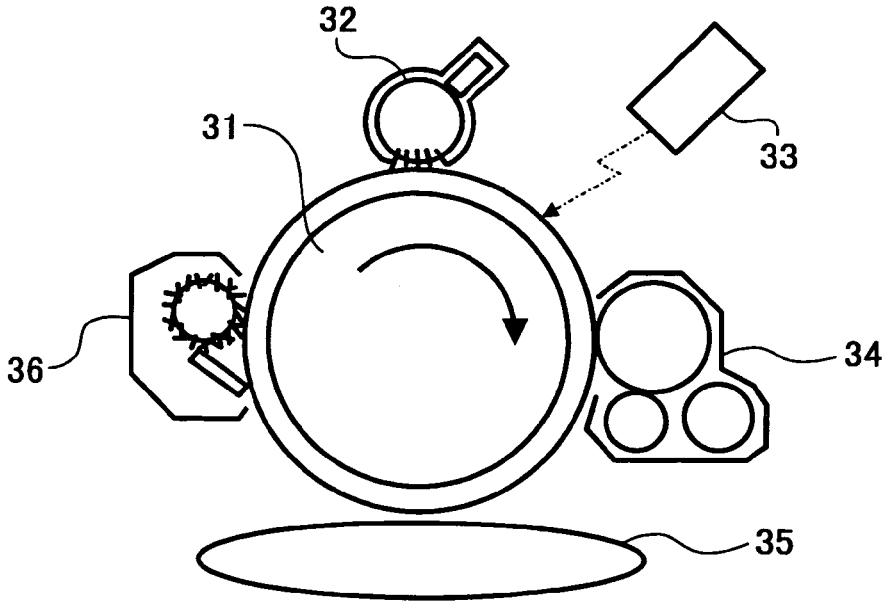
FIG. 9 is a schematic view illustrating a cross section of an embodiment of the image forming apparatus of the present invention.

FIG. 9 is a schematic view illustrating a cross section of an embodiment of the electrophotographic apparatus of the present invention.

In FIG. 9, an electrophotographic photoreceptor 31 includes a CGL and a CGTL, or a CGL 1, a CTL and a CGL 2 on an electroconductive substrate.

A charger 32 is located in contact with or closely associated to the electrophotographic photoreceptor 31. The charger is preferably constituted of a member (a bias applicator) capable of applying a bias and a LD or LED (a charging irradiator) generating a charge to charge the photoreceptor. However, a light source is not limited to the LD or LED, and a fluorescent lamp or a Xenon lamp may be used. In addition, a filter passing light which is absorbed by the CGL and the CGL 1 may be used.

The bias applicator has to transmit the light to perform the charging irradiation, and at the same time, has to maintain an electric field in the photosensitive layer for a time in which a hole generated by the CGTL or CGL 2 completes passing through the CTL (a transit time). For examples, bias applicators shown in FIGS. 10 and 11 have such capabilities.

Figure 10:
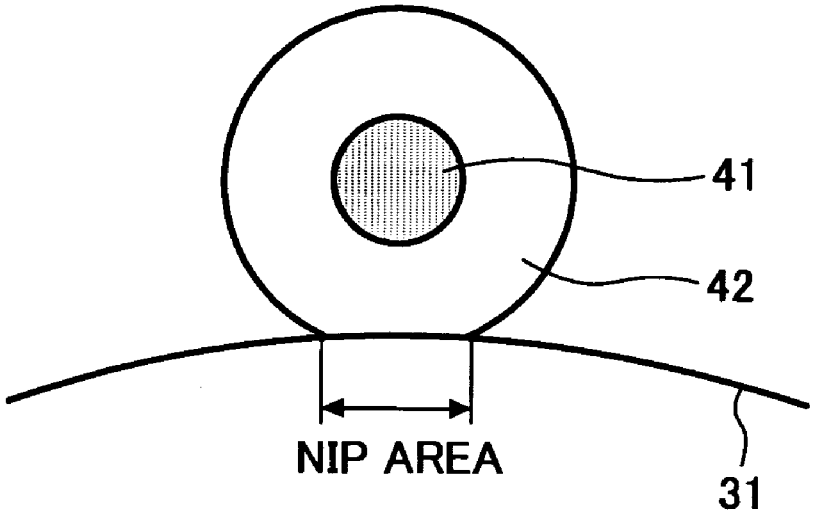
FIG. 10 is a schematic view illustrating a cross section of an embodiment of the bias applicator (bias application plate) for use in the charger of the present invention.

FIG. 10 is a bias applicator having a roller contacting a surface of the photoreceptor 31, which is formed of a metallic roller core 41 coated with a light transmittance electroconductive elastic member 42 having a transmittance for the exposed light, such as silicone elastomers and urethane rubbers. The light transmittance electroconductive elastic member 42 includes an adequate amount of a filler such as metal oxides and carbon imparting electroconductivity. For example, a roller which has a surface formed of a silicone elastomer having a low hardness including a titanium oxide as a filler, which is coated with a protection fluorocarbon resin film imparted with electroconductivity by a filler, etc. can also be used as the bias applicator. When the roller as the bias applicator (hereinafter referred to as a bias application roller) is contacted to the photoreceptor with a proper pressure, the bias application roller is deformed to form a nip with the photoreceptor. To obtain a sufficient charge, the nip width (a nip area length in the direction of photoreceptor movement) is preferably not less than a length determined by a product of the photoreceptor movement speed and the above-mentioned transit time.

Figure 11:
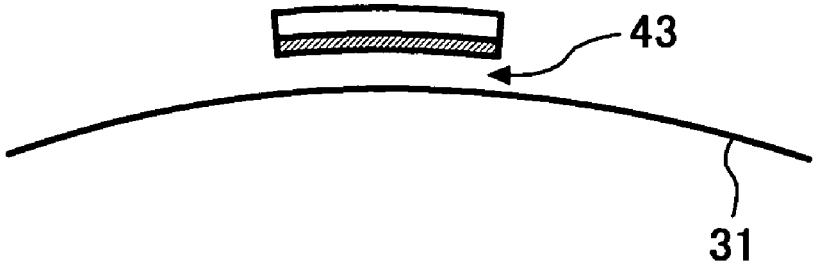
FIG. 11 is a schematic view illustrating a cross section of another embodiment of the bias applicator (bias application plate) for use in the charger of the present invention.

FIG. 11 is an example of using a non-contact bias applicator to the photoreceptor 31. This is a member formed of a glass base plate coated with an ITO film 43 (hereinafter referred to as a bias application plate). The bias application plate has an almost same curvature as that of the photoreceptor and is located such that a gap of a few hundreds μm is maintained therebetween. To obtain a sufficient charge, the bias application plate preferably has a length in the direction of photoreceptor movement not less than a length determined by a product of the photoreceptor movement speed and the above-mentioned transit time.

As an image signal writing irradiator 33, a LD or a LED is used. The irradiation light of the LD or LED has to have a wavelength which is different from that used in the above-mentioned charging irradiator. The image writing irradiator 33 forms an electrostatic latent image on the surface of the photoreceptor.

After the electrostatic latent image is formed on a surface of the photoreceptor, a toner image is formed by an image developer. The toner image formed on the surface of the photoreceptor is transferred onto a transfer material such as papers by a transferer 35. Then, the toner image is fixed to form a hard copy. A residual toner on the electrophotographic photoreceptor 31 is removed by a cleaner 36 to be prepared for the next electrophotographic process.

The electrophotographic process using the image forming method and photoreceptor of the present invention is not limited to the above-mentioned example, and any process of forming an electrostatic latent image by at least charging and irradiating can use the image forming method and photoreceptor of the present invention.

The above-mentioned image forming unit may be fixedly set in a copier, a facsimile or a printer. However, the image forming unit may be set therein as a process cartridge. The process cartridge means an image forming unit (or device) which includes a photoreceptor, a charger, an imagewise light irradiator, an image developer, an image transferer, a cleaner, and a discharger, etc.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

<Undercoat Layer>

On an aluminum substrate (outside diameter of 100 mm), the following undercoat layer coating liquid was coated by a dip coating method, and then dried to form an undercoat layer having a thickness of 3.5 μm.

(The undercoat Layer Coating Liquid)

| | |
|---|---|
| Alkyd resin3 (Bekkozol 1307-60-EL from Dainippon Ink & Chemicals, Inc.) | 3 |
| Melamine resin (Super Bekkamin G-821-60 from Dainippon Ink & Chemicals, Inc.) | 2 |
| Titanium oxide (CR-EL from Ishihara Sangyo Kaisha, Ltd.) | 20 |
| Methyl ethyl ketone | 100 |

<CGL>

The following charge generation layer coating liquid including a oxotitaniumphthalocyanine pigment was coated on the undercoat layer by a dip coating method and then dried at 110° C. for 20 min to form a CGL having a thickness of 0.3 μm.

(The CGL Coating Liquid)

| | |
|---|---|
| Oxotitaniumphthalocyanine pigment | 5 |
| Butyral resin (S-lec BMS (from Sekisui Chemical Co., Ltd.) | 2 |
| Tetrahydrofuran | 80 |

<CGTL>

The following CGTL coating liquid including a low molecular weight charge transport material and a bisazo charge generation material, having the following formulae respectively was coated on the CGL by a dip coating method, and dried at 130° C. for 20 min to from a CGTL having a thickness of 15 μm.

(The CGTL Coating Liquid)

| | |
|---|---|
| Bisphenol Z type polycarbonate | 10 |
| Low molecular weight hole charge transport material having the following formula: | 7 |

-continued

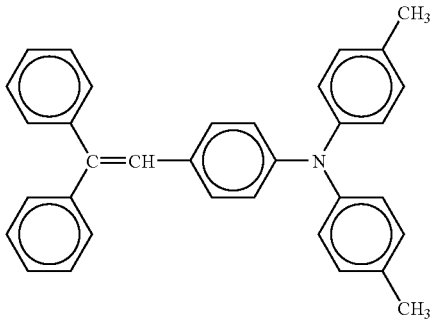

Bisazo charge generation material (pigment) having the following formula: 1

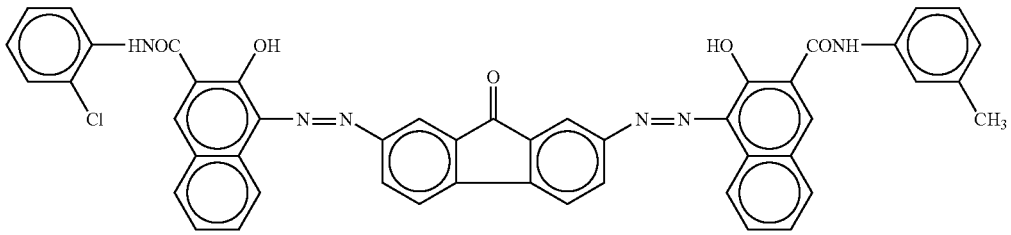

Tetrahydrofuran 100

Spectral sensitivities of the above-mentioned oxotitaniumphthalocyanine pigment and bisazo pigment are shown in FIG. 12. The bisazo pigment used in the CGTL was not sensitive to light having a wavelength not less than 740 nm.

The thus prepared photoreceptor was installed in a modified copier Imagio MF6550 with a LD image writing light source having a wavelength 780 nm from Ricoh Company, Ltd. The modified copier had a bias applicator shown in FIG. 10 and a charging irradiator with a LED light source having a wavelength of 655 nm.

Initial image and running image (A4) productions were performed by the modified copier. The initial image had a good background, black solid image and halftone image.

As a result of the running image (A4 having a 7% image area) production, the chargeability of the photoreceptor scarcely deteriorated until 100,000 images were produced. However, after the 100,000 images were produced, background fouling began to appear. Then, an abrasion amount of the CGTL was 4.5 μm. After 120,000 images were produced, the chargeability further deteriorated and the running image production was stopped. Then, the abrasion amount of the CGTL was 5.7 μm.

Example 2

The procedures of preparation for an electrophotographic photoreceptor and evaluations thereof in Example 1 were repeated except for forming a surface protection layer on the CGTL using the following plasma CVD apparatus.

Figure 13:
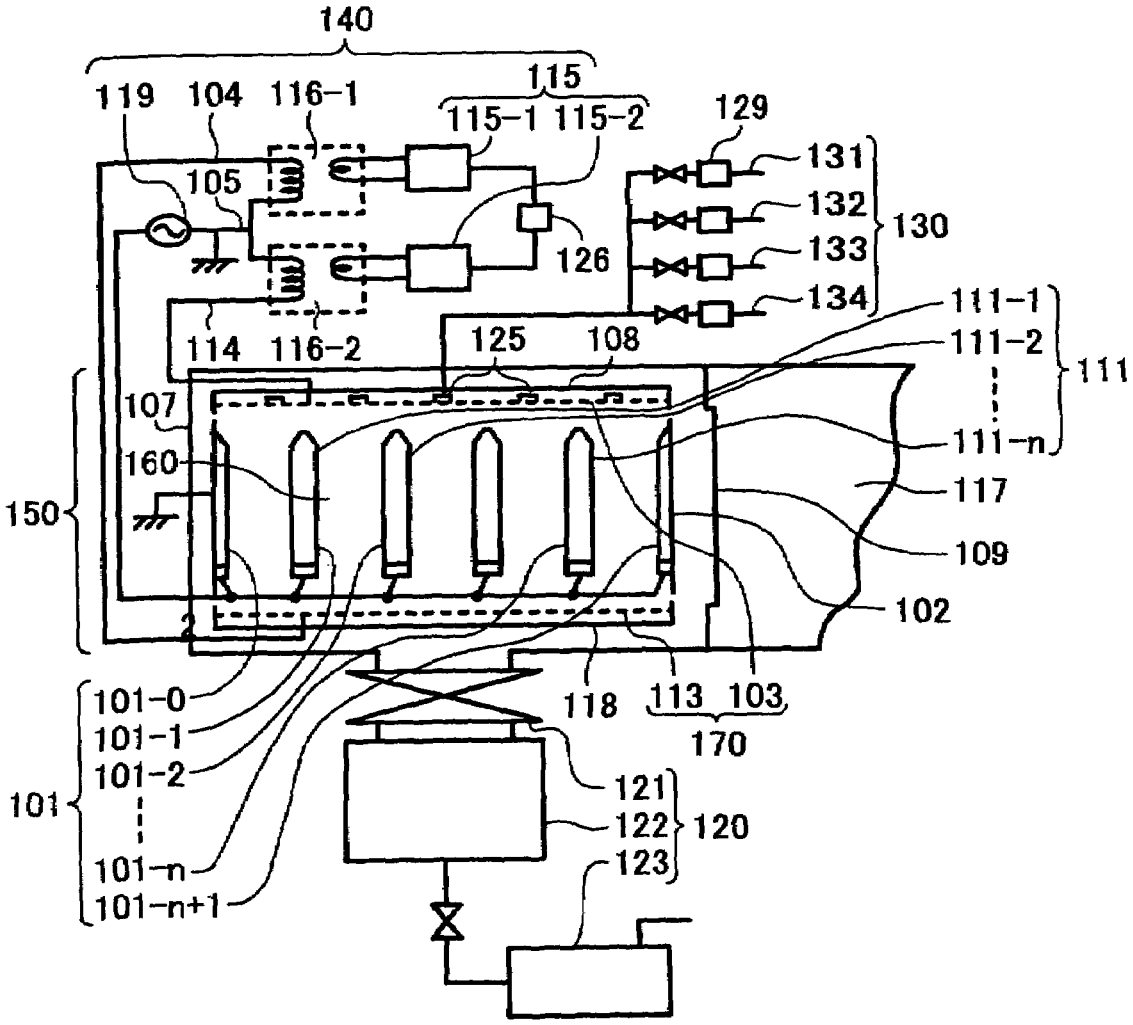
FIG. 13 is a schematic view illustrating an embodiment of the plasma CVD apparatus for forming the protection layer formed from a diamond-like carbon or an amorphous carbon structure including a hydrogen atom of the present invention.
Figure 14:
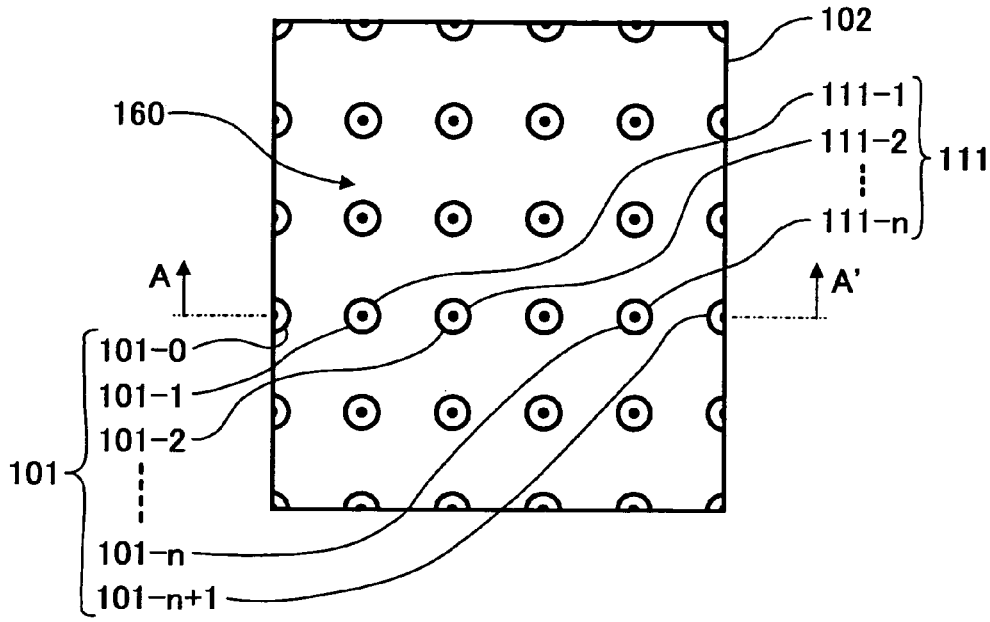
FIG. 14 is a plane view illustrating an embodiment of the casing structured body of the plasma CVD apparatus of the present invention.
Figure 15:
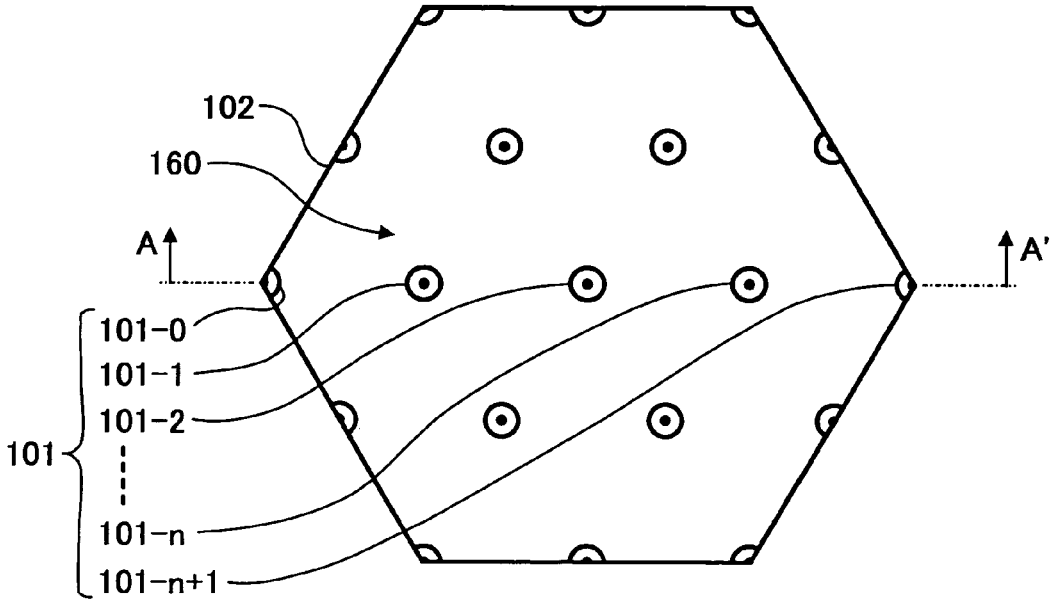
FIG. 15 is a plane view illustrating another embodiment of the casing structured body of the plasma CVD apparatus of the present invention.

An electrophotographic photoreceptor prepared by the procedures in Example 1 was set in a plasma CVD apparatus as shown in FIGS. 13 to 15 to form a surface protection layer on the photoreceptor. In FIG. 13, numeral 107 is a vacuum chamber of the plasma CVD apparatus, and is separated from a load/unload spare room 117 by a gate vale 109. The vacuum chamber 107 is vacuum pumped by an exhaust system formed of a pressure control valve 121, a turbo molecular pump 122 and a rotary pump 123, and therefore a certain pressure is maintained in the chamber. The vacuum chamber 107 includes a reaction chamber 150. The reaction chamber is formed of a frame constitute 102 as shown in FIGS. 14 and 15 (having a quadrangular or hexagonal shape when seen from an electric pole), hoods 108 and 118 covering openings of both ends thereof and a pair of a first and second electric poles 103 and 113 (formed of a metallic mesh such as aluminium) located on the hoods 108 and 118, having the same shapes thereof. Numeral 130 is a gas line leading to the reaction chamber 150, which is connected with containers of various gases and each of the gas is fed into the reaction chamber 150 from a nozzle 125 through a flowmeter 129.

In the frame constitute 102, substrates 101, 101-1, 101-2 and 101-n including the above-mentioned photosensitive layer are arranged as shown in FIGS. 14 and 15. Each of the substrate is arranged as a third electric pole as mentioned later. A pair of electric source 115, i.e., 115-1 and 115-2, is prepared for each of the electric poles 103 and 113 to apply a first alternate voltage. The first alternate voltage has a frequency of from 1 to 100 MHz. The electric sources 115-1 and 115-2 are respectively connected to matching trances 116-1 and 116-2. A phase in the matching trance is adjusted by a phase adjuster 126 and the voltages through the matching trances 116-1 and 116-2 can be fed at an angle of 180° or 0°. Namely, the electric source has a symmetric or an in-phase output power. An end 104 and the other end 114 of the matching trance are respectively connected to the first and second electric poles. A midpoint of the power output of the trance is maintained at a ground level.

Further, an electric source 119 is arranged to apply a second alternate voltage between the midpoint 105 and the third electric poles, i.e., the substrates 101, 101-1, 101-2 and 101-n or a holder 102 electrically connected to the electric poles. The second alternate voltage has a frequency of from 1 to 500 KHz. The first alternate voltage applied to the first and second electric poles has an output power of from 0.1 to 1 KW when having a frequency of 13.56 MHz. The second alternate voltage applied to the third electric pole, i.e., the substrate has an output power of 100 W when having a frequency of 150 KHz.

The surface protection layer was formed under the following conditions:

| | |
|---|---|
| $C_2H_4$ flow amount | 90 sccm |
| $H_2$ flow amount | 150 sccm |
| $NF_3$ flow amount | 45 sccm |
| Reaction pressure | 0.02 torr |
| the first alternate voltage | 200 W 13.56 MHz |
| bias voltage | −120 V |
| (content of direct current) thickness | 2.5 μm |

The initial image had a good background, black solid image and halftone image.

As a result of the running image (A4 having a 7% image area) production, the chargeability of the photoreceptor did not deteriorate and the image quality was good even after 500,000 images were produced. Then, an abrasion amount of the surface protection layer of the photoreceptor was 1.2 μm.

Example 3

The procedures of preparation for an electrophotographic photoreceptor and evaluations thereof in Example 1 were repeated except for forming a surface protection layer having the following components and a thickness of 4 μm on the CGTL.

(A Surface Protection Layer Coating Liquid)

| | |
|---|---|
| Bisphenol Z type polycarbonate | 6 |
| Fine particles of alumina (AA03 from Sumitomo Chemical Co., Ltd.) | 3 |
| Tetrahydrofuran | 110 |
| Cyclohexanone | 60 |

The initial image had a good background, black solid image and halftone image.

As a result of the running image (A4 having a 7% image area) production, the chargeability of the photoreceptor did not deteriorate and the image quality was good even after 500,000 images were produced. Then, an abrasion amount of the surface protection layer of the photoreceptor was 1.9 μm.

Example 4

The procedures of preparation for an electrophotographic photoreceptor and evaluations thereof in Example 1 were repeated except for forming a surface protection layer having the following components and a thickness of 6 μm on the CGTL.

(A Surface Protection Layer Coating Liquid)

| | |
|---|---|
| polyarylate resin (U-6000 from Unitika Ltd.) | 7 |
| Fine particles of silica (KMPX100 from Shin-Etsu Chemical Co., Ltd.) | 3 |
| Tetrahydrofuran | 110 |
| Cyclohexanone | 60 |

The initial image had a good background, black solid image and halftone image.

As a result of the running image (A4 having a 7% image area) production, the chargeability of the photoreceptor did not deteriorate and the image quality was good even after 500,000 images were produced. Then, an abrasion amount of the surface protection layer of the photoreceptor was 2.4 μm.

Comparative Example 1

The procedures of preparation for an electrophotographic photoreceptor and evaluations thereof in Example 1 were repeated except for using an oxotitaniumphthalocyanine pigment instead of the bisazo pigment in the CGTL.

The initial image had a good background and black solid image, but the halftone image was not good. This is because a charge generates in the CGTL when an image signal writing is performed.

Example 5

<Undercoat Layer>

On an aluminum substrate (outside diameter of 100 mm), the following undercoat layer coating liquid was coated by a dip coating method, and then dried to form an undercoat layer having a thickness of 3.5 μm.

(The undercoat Layer Coating Liquid)

| | |
|---|---|
| Alkyd resin (Bekkozol 1307-60-EL from Dainippon Ink & Chemicals, Inc.) | 3 |
| Melamine resin (Super Bekkamin G-821-60 from Dainippon Ink & Chemicals, Inc.) | 2 |
| Titanium oxide (CR-EL from Ishihara Sangyo Kaisha, Ltd.) | 20 |
| Methyl ethyl ketone | 100 |

<CGL 1>

The following charge generation layer 1 coating liquid including a oxotitaniumphthalocyanine pigment was coated on the undercoat layer by a dip coating method and then dried at 110° C. for 20 min to form a CGL 1 having a thickness of 0.3 μm.

(The CGL 1 Coating Liquid)

| | |
|---|---|
| Oxotitanium phthalocyanine pigment | 5 |
| Butyral resin (S-lec BMS (from Sekisui Chemical Co., Ltd.) | 2 |
| Tetrahydrofuran | 80 |

<CTL>

The following CTL coating liquid including a low molecular weight charge transport material and a bisazo charge generation material, having the following formulae respectively was coated on the CGL 1 by a dip coating method, and dried at 130° C. for 20 min to from a CGTL having a thickness of 20 μm.

(The CTL Coating Liquid)

| | |
|---|---|
| Bisphenol Z type polycarbonate | 1 |
| Low molecular weight charge transport material having the following formula: | 1 |
| Tetrahydrofuran | 10 |

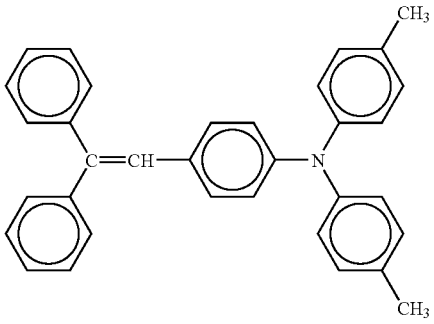

<CGL 2>

The following charge generation layer 2 coating liquid including a bisazo pigment was coated on the CTL by a spray coating method and then dried at 140° C. for 20 min to form a CGL 2 having a thickness of 3 μm.

(The CGL 2 Coating Liquid)

| | |
|---|---|
| Bisphenol Z type polycarbonate | 5 |
| Bisazo pigment having the following formula: | 2 |
| Tetrahydrofuran | 100 |
| Cyclohexanone | 40 |

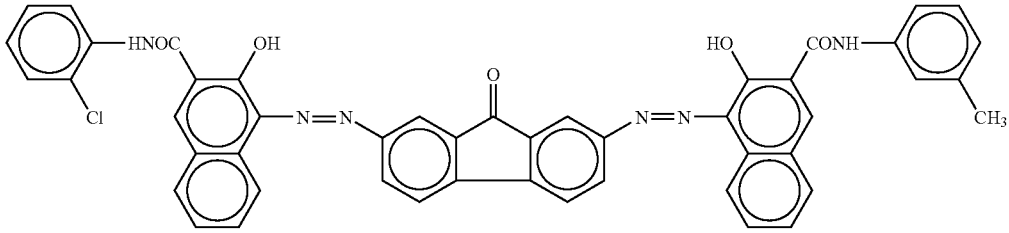

Spectral sensitivities of the above-mentioned oxotitaniumphthalocyanine pigment and bisazo pigment are shown in FIG. 12. The bisazo pigment used in the CGL 2 was not sensitive to light having a wavelength not less than 740 nm.

The thus prepared photoreceptor was installed in a modified copier Imagio MF6550 with a LD image writing light source having a wavelength 780 nm from Ricoh Company, Ltd. The modified copier had a bias applicator shown in FIG. 10 and a charging irradiator with a LED light source having a wavelength of 655 nm.

Initial image and running image (A4) productions were performed by the modified copier. The initial image had a good background, black solid image and halftone image.

As a result of the running image (A4 having a 7% image area) production, the chargeability of the photoreceptor gradually deteriorated and background fouling began to appear after 80,000 images were produced. After 110,000 images were produced, the chargeability further deteriorated and the running image production was stopped. Then, an abrasion amount of the CGL 2 was 2.7 μm.

Example 6

The procedures of preparation for an electrophotographic photoreceptor and evaluations thereof in Example 5 were repeated except for using the following components in the CGL 2.

| | |
|---|---|
| Bisphenol Z type polycarbonate | 4 |
| Bisazo pigment in Example 5 | 2 |
| Fine particles of silica (KMPX100 from Shin-Etsu Chemical Co., Ltd.) | 3 |
| Tetrahydrofuran | 100 |
| Cyclohexanone | 40 |

The initial image had a good background, black solid image and halftone image.

As a result of the running image (A4 having a 7% image area) production, the chargeability of the photoreceptor gradually deteriorated and background fouling began to appear after 230,000 images were produced. After 280,000 images were produced, the chargeability further deteriorated and the running image production was stopped. Then, an abrasion amount of the CGL 2 was 2.5 μm.

Example 7

The procedures of preparation for an electrophotographic photoreceptor and evaluations thereof in Example 5 were repeated except for forming a surface protection layer on the CGL 2 using the plasma CVD apparatus used in Example 2.

The surface protection layer was formed under the following conditions:

| | |
|---|---|
| $C_2H_4$ flow amount | 90 sccm |
| $H_2$ flow amount | 150 sccm |
| $NF_3$ flow amount | 45 sccm |
| reaction pressure | 0.02 torr |
| the first alternate voltage | 200 W 13.56 MHz |
| bias voltage (content of direct current) | −100 V |
| thickness | 2.0 μm |

The initial image had a good background, black solid image and halftone image.

As a result of the running image (A4 having a 7% image area) production, the chargeability of the photoreceptor did not deteriorate and the image quality was good even after 500,000 images were produced. Then, an abrasion amount of the surface protection layer of the photoreceptor was 1.2 μm.

Example 8

The procedures of preparation for an electrophotographic photoreceptor and evaluations thereof in Example 5 were repeated except for forming a surface protection layer having the following components and a thickness of 3 μm on the CGL 2.

(A Surface Protection Layer Coating Liquid)

| | |
|---|---|
| Bisphenol Z type polycarbonate | 6 |
| Fine particles of alumina (AA03 from Sumitomo Chemical Co., Ltd.) | 3 |
| Tetrahydrofuran | 100 |
| Cyclohexanone | 50 |

The initial image had a good background, black solid image and halftone image.

As a result of the running image (A4 having a 7% image area) production, the chargeability of the photoreceptor did not deteriorate and the image quality was good even after 500,000 images were produced. Then, an abrasion amount of the surface protection layer of the photoreceptor was 2.1 μm.

Comparative Example 2

The procedures of preparation for an electrophotographic photoreceptor and evaluations thereof in Example 5 were repeated except for using an oxotitaniumphthalocyanine pigment instead of the bisazo pigment in the CGL 2.

The initial image had a good background and black solid image, but the halftone image was not good. This is because a charge generates in the CGL 2 when an image signal writing is performed.

This document claims priority and contains subject matter related to Japanese Patent Applications Nos. 2002-045394, 2002-106845 and 2003-014086, filed on Feb. 21, 2002, Apr. 4, 2002 and Jan. 22, 2003 respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus comprising:

an electrophotographic photoreceptor;

a charger configured to charge the electrophotographic photoreceptor with light irradiation and bias application;

an irradiator configured to irradiate the electrophotographic photoreceptor with imagewise light to form an electrostatic latent image thereon;

an image developer configured to develop the electrostatic latent image with a developer including a toner to form a toner image thereon; and a transferer configured to transfer the toner image on to a transfer sheet, wherein the electrophotographic photoreceptor includes, an electroconductive substrate, a charge generation layer overlying the electroconductive substrate and configured to generate a first charge to form an electrostatic latent image when exposed to a first light having a first wavelength, and a charge generation and transport layer overlying the charge generation layer and configured to generate a second charge when exposed to a second light having a second wavelength different than the first wavelength and to transport the first and second charges to a surface of the photoreceptor.

2. A process cartridge comprising:

an electrophotographic photoreceptor; and a charger configured to charge the electrophotographic photoreceptor with light irradiation and bias application, wherein the electrophotographic photoreceptor includes, an electroconductive substrate, a charge generation layer overlying the electroconductive substrate and configured to generate a first charge to form an electrostatic latent image when exposed to a first light having a first wavelength, and a charge generation and transport layer overlying the charge generation layer and configured to generate a second charge when exposed to a second light having a second wavelength different than the first wavelength and to transport the first and second charges to a surface of the photoreceptor.

3. An image forming method comprising:

charging an electrophotographic photoreceptor while irradiating the photoreceptor with light and applying a bias thereto;

irradiating the electrophotographic photoreceptor with imagewise light to form an electrostatic latent image thereon;

developing the electrostatic latent image with a developer including a toner to form a toner image thereon; and transferring the toner image onto a transfer sheet, wherein the electrophotographic photoreceptor includes, an electroconductive substrate, a charge generation layer overlying the electroconductive substrate and configured to generate a first charge to form an electrostatic latent image when exposed to a first light having a first wavelength, and a charge generation and transport layer overlying the charge generation layer and configured to generate a second charge when exposed to a second light having a second wavelength different than the first wavelength and to transport the first and second charges to a surface of the photoreceptor.

4. An image forming apparatus comprising:

an electrophotographic photoreceptor;

a charger configured to charge the electrophotographic photoreceptor with light irradiation and bias application;

an irradiator configured to irradiate the electrophotographic photoreceptor with imagewise light to form an electrostatic latent image thereon;

an image developer configured to develop the electrostatic latent image with a developer including a toner to form a toner image thereon; and a transferer configured to transfer the toner image on to a transfer sheet, wherein the electrophotographic photoreceptor includes, an electroconductive substrate, a first charge generation layer overlying the electroconductive substrate and configured to generate a first charge to form an electrostatic latent image when exposed to a first light having a first wavelength, said first charge generation layer including a first charge generation material, a charge transport layer overlying the first charge generation layer, and a second charge generation layer overlying the charge transport layer and configured to generate a second charge when exposed to a second light having a second wavelength different than the first wavelength, said second charge generation layer including a second charge generation material, and wherein the charge transport layer transports the first charge to the second charge generation layer.

5. A process cartridge comprising:

an electrophotographic photoreceptor; and a charger configured to charge the electrophotographic photoreceptor with light irradiation and bias application, wherein the electrophotographic photoreceptor includes, an electroconductive substrate, a first charge generation layer overlying the electroconductive substrate and configured to generate a first charge to form an electrostatic latent image when exposed to a first light having a first wavelength, said first charge generation layer including a first charge generation material, a charge transport layer overlying the first charge generation layer, and a second charge generation layer overlying the charge transport layer and configured to generate a second charge when exposed to a second light having a second wavelength different than the first wavelength, said second charge generation layer including a second charge generation material, and wherein the charge transport layer transports the first charge to the second charge generation layer.

6. An image forming method comprising:

charging an electrophotographic photoreceptor while irradiating the photoreceptor with light and applying a bias thereto;

irradiating the electrophotographic photoreceptor with imagewise light to form an electrostatic latent image thereon;

developing the electrostatic latent image with a developer including a toner to form a toner image thereon; and transferring the toner image on to a transfer sheet, wherein the electrophotographic photoreceptor includes, an electroconductive substrate, a first charge generation layer overlying the electroconductive substrate and configured to generate a first charge to form an electrostatic latent image when exposed to a first light having a first wavelength, said first charge generation layer including a first charge generation material, a charge transport layer overlying the first charge generation layer, and a second charge generation layer overlying the charge transport layer and configured to generate a second charge when exposed to a second light having a second wavelength different than the first wavelength, said second charge generation layer including a second charge generation material, and wherein the charge transport layer transports the first charge to the second charge generation layer.

* * * * *